US005965989A

United States Patent [19]

Mader

[11] Patent Number: 5,965,989

[45] Date of Patent: Oct. 12, 1999

[54] TRANSFORMER PRIMARY SIDE LAMP CURRENT SENSE CIRCUIT

[75] Inventor: Urs H. Mader, Sunnyvale, Calif.

[73] Assignee: Micro Linear Corporation, San Jose, Calif.

[21] Appl. No.: 08/688,520

[22] Filed: Jul. 30, 1996

[51] Int. Cl.[6] ..... H01F 27/42; H05B 41/00

[52] U.S. Cl. ..... 315/279; 315/DIG. 4; 315/307; 323/301; 336/155; 363/25

[58] Field of Search ..... 315/307, 291, 315/DIG. 4, 276, 278, 279; 323/250, 312, 302, 301; 363/25, 26; 336/30, 155

[56] References Cited

U.S. PATENT DOCUMENTS

| | | | |
|---|---|---|---|
| 2,483,815 | 10/1949 | Easton | 175/356 |
| 2,967,267 | 1/1961 | Steinman et al. | 317/101 |
| 3,292,579 | 12/1966 | Buchanan | 119/5 |
| 3,549,990 | 12/1970 | Hochheiser | 323/44 |
| 3,611,021 | 10/1971 | Wallace | 315/239 |
| 3,671,782 | 6/1972 | Wittlinger et al. | 307/238 |
| 3,723,891 | 3/1973 | Whiteley | 329/103 |
| 3,758,823 | 9/1973 | Jett et al. | 315/219 |
| 3,772,625 | 11/1973 | Raupach | 336/94 |
| 3,778,677 | 12/1973 | Kriege | 315/219 |
| 3,810,026 | 5/1974 | Roth . | |
| 3,828,203 | 8/1974 | Belson et al. . | |
| 3,840,795 | 10/1974 | Roszyk et al. | 320/2 |
| 3,893,036 | 7/1975 | Cavoretto et al. . | |
| 3,921,005 | 11/1975 | Watrous | 307/64 |
| 3,953,768 | 4/1976 | Meredith et al. | 317/31 |
| 4,030,058 | 6/1977 | Riffe et al. | 336/92 |

(List continued on next page.)

FOREIGN PATENT DOCUMENTS

| | | | |
|---|---|---|---|
| 0 059 064 | 9/1982 | European Pat. Off. | H05B 41/392 |
| 0 178 852 | 4/1986 | European Pat. Off. | H05B 41/26 |
| 32 33 655 A1 | 5/1983 | Germany | H05B 41/29 |
| 34 32 266 A1 | 3/1985 | Germany | H05B 41/26 |
| 9201334 | 1/1992 | WIPO | H03K 3/281 |

OTHER PUBLICATIONS

J. Williams, "Techniques for 92% Efficient LCD Illumination" *Linear Technology Application Note* 55, pp. 1–43, Aug. 1993.

Micro Linear, "ML4874 LCD Backlight Lamp Drive," pp. 1–6, Apr. 1994.

Micro Linear, "ML4876 LCD Backlight Lamp Driver with Contrast," pp. 1–6, Apr. 1994.

*Primary Examiner*—Arnold Kinkead

*Attorney, Agent, or Firm*—Haverstock & Owens LLP

[57] ABSTRACT

A circuit that senses a current signal in a secondary winding of a transformer by monitoring a current signal in a primary winding of the transformer. The monitored current signal contains an effective current component and a magnetization current component. The magnitude of the effective current signal is related to the magnitude of the current signal in the secondary winding by the turns ratio of the transformer. The magnetization current signal produces flux in the transformer core and does not contribute to producing current in the secondary winding of the transformer. In addition, the magnetization current is 90 degrees out of phase with the effective current signal in the primary winding. The effective current signal in the primary winding is in phase with the voltage signal applied to the primary winding. The invention integrates the monitored current signal over 0 degrees to 180 degrees of the effective current signal waveform. Since the magnetization current signal is 90 degrees out of phase with the effective current signal, the magnetization current signal component is cancelled from the monitored current signal by the integration operation. Therefore, the result of the integration operation is representative of a current signal in the secondary winding of the transformer and does not contain error caused by the magnetization current of the transformer. The result of the integration operation is used in a feedback loop to control the current in the secondary winding. In a preferred embodiment of the invention, a fluorescent lamp is coupled to the secondary winding of the transformer.

28 Claims, 7 Drawing Sheets

U.S. PATENT DOCUMENTS

| | | | |
|---|---|---|---|
| 4,031,449 | 6/1977 | Trombly | 320/2 |
| 4,038,625 | 7/1977 | Tompkins et al. | 336/83 |
| 4,063,108 | 12/1977 | Klett et al. | 307/64 |
| 4,127,795 | 11/1978 | Knoll | 315/210 |
| 4,144,462 | 3/1979 | Sieron et al. | 307/66 |
| 4,145,592 | 3/1979 | Mizukawa et al. | 219/10.49 R |
| 4,146,857 | 3/1979 | Schleupen | 336/61 |
| 4,163,923 | 8/1979 | Herbers et al. | 315/208 |
| 4,172,981 | 10/1979 | Smith | 307/66 |
| 4,207,498 | 6/1980 | Spira et al. | 315/97 |
| 4,210,746 | 7/1980 | Capewell et al. | 315/121 |
| 4,225,825 | 9/1980 | Watts . | |
| 4,251,752 | 2/1981 | Stolz | 315/206 |
| 4,260,943 | 4/1981 | Zaderej et al. | 320/21 |
| 4,277,726 | 7/1981 | Burke | 315/98 |
| 4,277,728 | 7/1981 | Stevens | 315/307 |
| 4,297,614 | 10/1981 | Chandler | 315/86 |
| 4,303,902 | 12/1981 | Lesster et al. | 336/83 |
| 4,318,608 | 3/1982 | Payne | 355/3 CH |
| 4,390,844 | 6/1983 | Ting . | |
| 4,412,265 | 10/1983 | Buuck | 361/18 |
| 4,414,493 | 11/1983 | Henrich | 315/308 |
| 4,441,053 | 4/1984 | Daspit | 315/206 |
| 4,441,054 | 4/1984 | Bay | 315/219 |
| 4,453,109 | 6/1984 | Stupp et al. | 315/219 |
| 4,486,689 | 12/1984 | Davis et al. | 315/92 |
| 4,495,446 | 1/1985 | Brown et al. | 315/206 |
| 4,496,896 | 1/1985 | Melocik et al. | 320/2 |
| 4,498,031 | 2/1985 | Stupp et al. | 315/307 |
| 4,523,131 | 6/1985 | Zansky | 315/307 |
| 4,528,482 | 7/1985 | Merlo | 315/291 |
| 4,543,556 | 9/1985 | Taylor et al. | 336/210 |
| 4,572,988 | 2/1986 | Handler et al. | 315/209 R |
| 4,585,974 | 4/1986 | Stupp et al. | 315/307 |
| 4,604,552 | 8/1986 | Alley et al. | 315/176 |
| 4,612,479 | 9/1986 | Zansky | 315/194 |
| 4,654,573 | 3/1987 | Rough et al. | 320/2 |
| 4,686,427 | 8/1987 | Burke | 315/219 |
| 4,698,554 | 10/1987 | Stupp et al. | 315/307 |
| 4,700,113 | 10/1987 | Stupp et al. | 315/224 |
| 4,704,563 | 11/1987 | Hussey | 315/307 |
| 4,717,863 | 1/1988 | Zeiler | 315/307 |
| 4,723,098 | 2/1988 | Grubbs | 315/306 |
| 4,739,227 | 4/1988 | Anderson | 315/260 |
| 4,763,239 | 8/1988 | Ball | 363/98 |
| 4,800,328 | 1/1989 | Bolger et al. | 320/2 |
| 4,806,880 | 2/1989 | Laws | 331/8 |
| 4,874,989 | 10/1989 | Nilssen | 315/151 |
| 4,893,059 | 1/1990 | Nilssen | 315/127 |
| 4,896,077 | 1/1990 | Dodd et al. | 315/289 |
| 4,920,299 | 4/1990 | Presz et al. | 315/98 |
| 4,935,669 | 6/1990 | Nilssen | 315/105 |
| 4,942,352 | 7/1990 | Sano | 320/2 |
| 4,952,849 | 8/1990 | Fellows et al. | 315/307 |
| 4,962,344 | 10/1990 | Bohrer | 307/260 |
| 5,015,919 | 5/1991 | Vila-Masot et al. | 315/86 |
| 5,045,732 | 9/1991 | Sugiura et al. | 307/529 |
| 5,048,033 | 9/1991 | Donahue et al. | 372/38 |
| 5,049,790 | 9/1991 | Herfurth et al. | 315/291 |
| 5,111,118 | 5/1992 | Fellows et al. | 315/307 |
| 5,177,408 | 1/1993 | Marques | 315/291 |
| 5,202,608 | 4/1993 | Johnson | 315/86 |
| 5,214,352 | 5/1993 | Love | 315/86 |
| 5,216,402 | 6/1993 | Carosa | 336/66 |
| 5,264,776 | 11/1993 | Hulsey | 320/2 |
| 5,363,020 | 11/1994 | Chen et al. | 315/209 R |
| 5,367,223 | 11/1994 | Eccher | 315/97 |
| 5,367,224 | 11/1994 | Pacholok | 315/219 |
| 5,367,242 | 11/1994 | Hulman | 320/2 |
| 5,384,516 | 1/1995 | Kawabata et al. | 315/160 |
| 5,394,020 | 2/1995 | Nienaber | 327/140 |
| 5,408,162 | 4/1995 | Williams | 315/224 |
| 5,410,188 | 4/1995 | Segaram | 327/237 |
| 5,410,221 | 4/1995 | Mattas et al. | 315/307 |
| 5,615,093 | 3/1997 | Nalbant | 363/25 |
| 5,642,066 | 6/1997 | Burke | 327/132 |

OTHER PUBLICATIONS

U. Mader, et al., Micro Linear, "Application Note 26—Power Conversion Efficiencies for Miniature Fluorescent Lamp," pp.1–6, Feb. 1994.

K. Kit Sum, et al., Micro Linear, "Application Note 32—Theory and Application of the ML4874 and ML4876 LCD Backlight Controller ICs," pp. 1–12, Jun. 1994.

J. J. LoCascio and U. H. Mader, "A New Control Technique Uses 25% Less Power To Drive Miniature Cold Cathode Fluorescent Lamps," *Electronic Ballast,* pp. 60–69, Apr. 1994.

M. Jordan and A.A. O'Connor, "Resonant Fluorescent Lamp Converter Provides Efficient and Compact Solution," *IEEE,* pp. 424–431, 1993.

Maxim Integrated Products, "CCFT Backlight and LCD Contrast Controllers—MAX753/MAX754," pp. 1–12, Feb. 1994.

K. Kit Sum, Micro Linear, "ML4874 Evaluation Kit User's Guide—LCD Backlight Lamp Driver," pp. 1–5, Apr. 1994.

Micro Linear, "ML4864 Evaluation User's Guide—LCD Backlight Lamp Driver with Contrast Control," pp. 1–4, Jan. 1994.

Micro Linear, "ML4864 LCD Backlight Lamp Driver with Contrast Control," pp. 1–6, Nov. 1993.

Micro Linear, "Advance Information ML–4830 Electronic Ballast Controller", Jun. 1992.

Micro Linear, "Advance Information ML–4830 Electronics Ballast Controller", Jul. 1992.

300c

TRANSFORMER PRIMARY SIDE LAMP CURRENT SENSE CIRCUIT

FIELD OF THE INVENTION

The invention relates to the field of circuits for monitoring current flow in a secondary winding of a transformer by sensing current flow in a primary winding of the transformer. In particular, the invention relates to circuits for monitoring current flow in a secondary winding of a transformer which account for a magnetization current of the transformer by integrating a current in the primary winding over time.

BACKGROUND OF THE INVENTION

Fluorescent lamps have "negative resistance." This means that the operating voltage decreases as power dissipation in the lamp increases. Therefore, a circuit for supplying power to a fluorescent lamp requires a controllable alternating current power supply and a feedback loop that accurately monitors a current signal in the lamp in order to maintain operating stability of the circuit and to have an ability to control the lamp brightness. Such a circuit for supplying power to a fluorescent lamp may comprise a transformer wherein the lamp is coupled to a secondary winding of the transformer and is isolated from the rest of the circuit, including the sensing circuit, by the transformer. This makes directly sensing the lamp current signal difficult. Therefore, what is needed is a circuit for accurately sensing the current in a fluorescent lamp that is isolated from the sensing circuit by a transformer.

One such known circuit utilizes a resistor coupled in series with the transformer primary winding. During operation, a voltage signal across the resistor is monitored for utilization by the feedback loop. This voltage signal is multiplied by the resistance value to determine the current signal in the primary winding of the transformer. The current signal in the secondary winding is assumed to relate to the current signal in the primary winding by the ratio of turns between the primary and secondary windings. Therefore, the current signal in the secondary winding of the transformer is sensed indirectly by sensing the voltage signal across the resistor coupled in series with the primary winding.

Transformers, however, suffer from an operational characteristic that the above-described current sensing technique does not take into account. A Magnetization current of a transformer is the current required to produce magnetic flux in the transformer core. FIG. 1 shows a schematic diagram of an approximate equivalent transformer circuit which takes into account the magnetization current. In FIG. 1, the transformer comprises a primary winding Lp and a secondary winding Ls. An inductor Lm coupled in parallel with the primary winding Lp models the effects of the magnetization current Im. It can be seen from FIG. 1 that when an ac voltage signal Vp is applied to the primary winding Lp, the resulting current signal Ip is divided into the magnetization current signal Im and the effective current signal Ie. The magnetization current signal Im lags the voltage signal Vp by 90 degrees. In addition, the magnetization current signal Ie does not directly contribute to inducing current to flow in the secondary winding Ls. Therefore, the above-described technique of sensing current in a secondary winding of a transformer suffers from error caused by not taking the magnetization current into account.

Therefore, what is needed is a circuit for sensing a current signal in a secondary winding of a transformer by monitoring a current signal in a primary winding of the transformer which accounts for the magnetization current of the transformer.

SUMMARY OF THE INVENTION

The invention is a circuit that senses a current signal in a secondary winding of a transformer by monitoring a current signal in a primary winding of the transformer. The monitored current signal contains an effective current component and a magnetization current component. The magnitude of the effective current signal is related to the magnitude of the current signal in the secondary winding by the turns ratio of the transformer. The magnetization current signal produces flux in the transformer core and does not directly contribute to inducing current to flow in the secondary winding of the transformer. Therefore, it is desirable to eliminate the magnetization current from the current signal in the primary winding in order to accurately determine the current signal in the secondary winding. In addition, the magnetization current is 90 degrees out of phase with the effective current signal in the primary winding. The effective current signal in the primary winding is in phase with the voltage signal applied to the primary winding.

The invention integrates the monitored current signal over 0 degrees to 180 degrees of the effective current signal waveform. Since the magnetization current signal is 90 degrees out of phase with the effective current signal, the magnetization current signal component is cancelled from the monitored current signal by the integration operation. Therefore, the result of the integration operation is representative of a current signal in the secondary winding of the transformer and does not contain error caused by failing to take into account the magnetization current of the transformer. The result of the integration operation is used in a feedback loop to control the current in the secondary winding. In a preferred embodiment of the invention, a fluorescent lamp is coupled to the secondary winding of the transformer.

DETAILED DESCRIPTION OF THE PREFERRED EMBODIMENT

Figure 1:
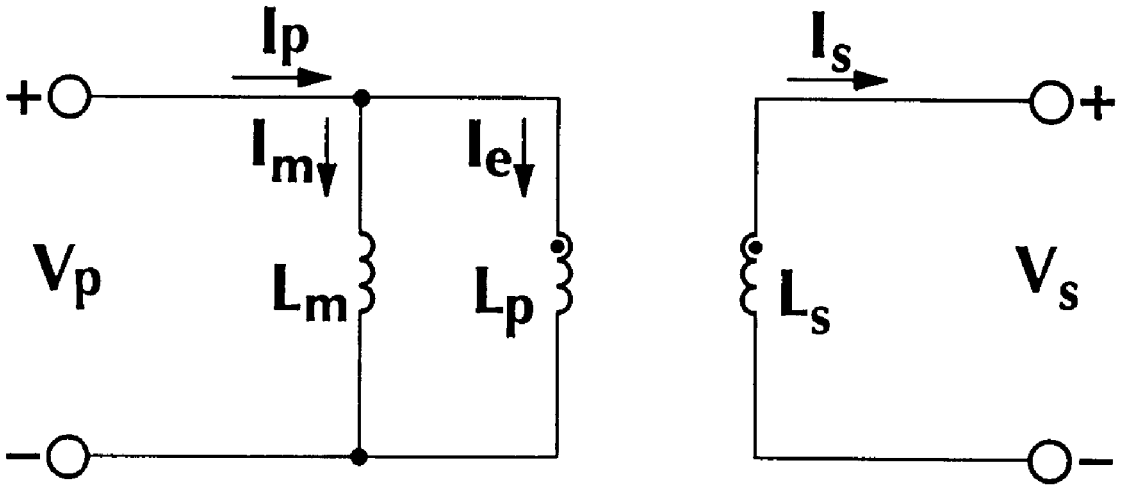
FIG. 1 shows a schematic diagram of an approximate equivalent real transformer circuit which takes into account a magnetization current of the transformer.

Referring to FIG. 2, a controller 300 of the present invention is shown. The present invention comprises a portion of the controller 300, however, the entire controller 300 is shown for illustrative purposes. The controller 300 preferably comprises an integrated circuit chip, but could be constructed from discrete components. Further, the controller 300 is preferably an integrated circuit chip controller available from Micro Linear Corporation, located at 2092 Concourse Drive, in San Jose, Calif. zip code 95131, under part number ML4878.

The controller comprises a minimum frequency bias circuit 301, a feed forward biasing circuit 302, an over voltage detector circuit 303, an oscillator and sync logic circuit 304, a zero crossing detector circuit 305, a feedback circuit 306, a linear regulator circuit 307, a bias & bandgap reference circuit 308, a negative edge delay circuit 309, a lamp out detector circuit 310, a duty cycle comparator circuit 311, a 50% duty cycle limit circuit 312, a dead time logic circuit 313 and a high side drive correction circuit 314. The controller also comprises a COMP pin 1, a CTLO pin 2, an ISNS pin 3, an RR pin 4, an RT pin 5, an ON/OFF pin 6, a DIM pin 7, a BATT pin 8, an OUTP pin 9, a VCC pin 10, an OUTN pin 11, a GND pin 12, a CHSC pin 13, and a VSNS pin 14.

The VSNS pin 14 is coupled to a non-inverting input to a comparator 315 and to a non-inverting input to a comparator 316. An inverting input to the comparator 315 is coupled to a voltage source of 0.25 volts. An inverting input to the comparator 316 is coupled to the ground node. An output of the comparator 315 is coupled to an S input to an R-S flip-flop 317 and to an S input to an R-S flip-flop 318. A Q output of the flip-flop 317 is coupled to a first input to an OR gate 319. A Q output of the flip-flop 318 is coupled a second input to the OR gate 319.

An output of the comparator 316 is coupled to a gate of an NMOSFET 320, to an input to an inverter 321, and to a first input to an AND gate 322. An output of the inverter 321 is coupled to a clock input to a T flip-flop 323, to a first input to an AND gate 324, and to a first input to an AND gate 325. An X-not output of the T flip-flop 323 is coupled to a second input to the AND gate 324, to a first input to an AND gate 326, to a first input to an AND gate 327, and to a first input to an AND gate 328. The output of the comparator 316 is also coupled to a second input to the AND gate 326. An X output of the T flip flop 323 is coupled to a second input to the AND gate 325, to a first input to an AND gate 329, to a second input to the AND gate 322, and to a first input to an AND gate 330.

An output of the AND gate 325 is coupled to an R input to the R-S flip-flop 318 and to a gate of an NMOSFET 331. An output of the AND gate 324 is coupled to an R input to the R-S flip-flop 317 and to a gate of an NMOSFET 332. An output of the AND gate 326 is coupled to an S input to an R-S flip-flop 333. A Q output of the R-S flip-flop 333 is coupled to a second input to the AND gate 329. An output of the AND gate 322 is coupled to an S input to an R-S flip-flop 334. A Q output of the R-S flip-flop 334 is coupled to a second input to the AND gate 327.

An output of the AND gate 329 is coupled to an inverting input to a transconductance amplifier 335. A non-inverting input to the transconductance amplifier 335 is coupled to a voltage source of 2.5 volts. An output of the transconductance amplifier 335 is coupled to an inverting input to a comparator 336, to a first terminal of a capacitor 337, to a drain of the NMOSFET 331, to an inverting input to a transconductance amplifier 338, and to an inverting input to a comparator 339. A second terminal of the capacitor 337 is coupled to a source of the NMOSFET 331 and to the ground node. A non-inverting input to the comparator 336 is coupled to a voltage source of 0.3 volts. An output of the comparator 336 is coupled to an R input to the R-S flip-flop 333. A non-inverting input to the transconductance amplifier 338 is coupled to a voltage source of 1.9 volts. An output of the transconductance amplifier 338 is coupled to an anode of a diode 340. A cathode of the diode 340 and a first terminal of a current mirror 341 are coupled to the transconductance amplifier 335 to control the gain of the transconductance amplifier 335.

An output of the AND gate 327 is coupled to an inverting input to a transconductance amplifier 342. A non-inverting input to the transconductance amplifier 342 is coupled to a voltage source of 2.5 volts. An output of the transconductance amplifier 342 is coupled to an inverting input to a comparator 343, to a first terminal of a capacitor 344, to a drain of the NMOSFET 332, to an inverting input to a transconductance amplifier 345, and to an inverting input to a comparator 346. A second terminal of the capacitor 344 is coupled to a source of the NMOSFET 332 and to the ground node. A non-inverting input to the comparator 343 is coupled to a voltage source of 0.3 volts. An output of the comparator 343 is coupled to an R input to the R-S flip-flop 334. A non-inverting input to the transconductance amplifier 345 is coupled to a voltage source of 1.9 volts. An output of the transconductance amplifier 345 is coupled to an anode of a diode 347. A cathode of the diode 347 and a second terminal of a current mirror 341 are coupled to the transconductance amplifier 342 to control the gain of the transconductance amplifier 342.

A third terminal of the current mirror 341 is coupled to a collector of an npn bipolar transistor 348. An emitter of the bipolar transistor 348 is coupled to an inverting input to a amplifier 349 and to the RT pin 5. A non-inverting input to the amplifier 349 is coupled to a voltage source of 2 volts. An output of the amplifier 349 is coupled to a base of the bipolar transistor 348. A fourth terminal of the current mirror 341 is coupled to a first terminal of a current mirror 350 and to a first terminal of a current mirror 351. A second terminal of the current mirror 350 is coupled to the RR pin 4. A third terminal of the current mirror 350 is coupled to the ground node. A second terminal of the current mirror 351 is coupled to control the gain of the transconductance amplifier 338. A third terminal of the current mirror 351 is coupled to control the gain of the transconductance amplifier 345.

An output of the OR gate 319 is coupled to a gate of an NMOSFET 352, to an input to an inverter 353, and to a first input to an OR gate 354. The ISNS pin 3 is coupled to a non-inverting input to a transconductance amplifier 355. An inverting input to the transconductance amplifier 355 is coupled to the ground node. An output of the transconductance amplifier 355 is coupled to a drain of the NMOSFET 320. A source of the NMOSFET 320 is coupled to a source of the NMOSFET 352, to a source of an NMOSFET 356, to a cathode of a 1.9 volt Zener diode 357, to a source of an NMOSFET 358, to a noninverting input to the comparator 339, to a non-inverting input to the comparator 346, and to the COMP pin 1. An anode of the diode 357 is coupled to the ground node. A drain of the NMOSFET 356 is coupled to a first terminal of a 5K ohms resistor 359. A second terminal of the resistor 359 is coupled to a voltage source of 0.3 volts. A drain of the NMOSFET 352 is coupled to a first terminal of a 100K ohms resistor 360. A second terminal of the resistor 360 is coupled to a voltage source of 0.4 volts.

An output of the inverter 353 is coupled to a gate of the NMOSFET 358. The DIM pin 7 is coupled to a non-inverting input to a transconductance amplifier 361. An inverting input to the transconductance amplifier 361 is coupled to a voltage source of 0.5 volts. An output of the transconductance amplifier 361 is coupled to a drain of the NMOSFET 358. The ON/OFF pin 6 is coupled to an input to a buffer 362. An output of the buffer 362 is coupled to an ON input to the linear regulator 307, and to an ON input to the bias & bandgap reference circuit 308. The BATT pin 8 is coupled to a power source for the linear regulator 307. The VCC pin 10 is coupled to the linear regulator 307. A REF terminal of the linear regulator is coupled to a REF terminal of the bias & bandgap reference circuit 308. An output UV of the bias & and bandgap reference circuit 308 is coupled to an input to the 40 us negative edge delay circuit 309.

An output of the negative edge delay circuit 309 is coupled to a gate of the NMOSFET 356, to a gate of an NMOSFET 363, to a first input to an AND gate 364, to a first inverted input to an AND gate 365, and to a first input to an OR gate 366. A drain of the NMOSFET 363 is coupled a non-inverting input to a comparator 367, to an output of a transconductance amplifier 368, and to the CTLO pin 2. A source of the NMOSFET 363 is coupled to the ground node. An inverting input to the comparator 367 is coupled to a voltage source of 3 volts. An output of the comparator 367 is coupled to a second input to the AND gate 364 and to a second input to the OR gate 354. An output of the OR gate 354 is coupled to a non-inverting input to the transconductance amplifier 368. An inverting input to the transconductance amplifier 368 is coupled to a voltage source of 2.5 volts. The transconductance amplifier is biased with a current of 1 $\mu$A.

An output of the AND gate 364 is coupled to an RS input to the flip-flop 323 and to a first inverting input to an AND gate 369. An output of the comparator 339 is coupled to a second input to the AND gate 330. An output of the comparator 346 is coupled to a second input to the AND gate 328. An output of the AND gate 330 is coupled to a first input to an OR gate 370. An output of the AND gate 328 is coupled a second input to the OR gate 370. An output of the OR gate 370 is coupled to an S input to an R-S flip-flop 371 and to a second input to the AND gate 369. A Q output of the flip-flop 371 is coupled to a third input to the AND gate 369. An output of the AND gate 369 is coupled to a second input to the AND gate 365 and to a non-inverting input to a transconductance amplifier 372. An inverting input to the transconductance amplifier 372 is coupled to a voltage source of 2.5 volts. A fifth terminal of the current mirror 341 is coupled to control the gain of the transconductance amplifier 372.

An output of the transconductance amplifier 372 is coupled to a first terminal of a capacitor 373 and to a non-inverting input to a comparator 374. A second terminal of the capacitor 373 is coupled to the ground node. An inverting input to the comparator 374 is coupled to the ground node. An output of the comparator 374 is coupled to an R input to the flip-flop 371. An output of the AND gate 365 is coupled to a first input to an OR gate 375. An output of the OR gate 375 is coupled to an input to a 100 ns delay circuit 376, to a first input to a NAND gate 377, and to a second input to the NOR gate 366. An output of the delay circuit 376 is coupled to a second input to the NAND gate 377 and to a third input to the NOR gate 366.

An output of the NOR gate 366 is coupled to an input to a buffer 378. An output of the buffer 378 is coupled to the OUTN pin 11. An output of the NAND gate 377 is coupled to an input to a buffer 379. An output of the buffer 379 is coupled to the OUTP pin 9 and to an input to an inverter 380. An output of the inverter 380 is coupled to a gate of an NMOSFET 381. A source of the NMOSFET 381 is coupled to the ground node. A drain of the NMOSFET 382 is coupled to the CHSC pin 13, to a cathode of a 2.1 volt Zener diode 382, and to a non-inverting input to a comparator 383. An inverting input to the comparator 383 is coupled a voltage source of 1.4 volts. An output of the comparator 383 is coupled to an input to a 200 ns positive edge delay circuit 384. An output of the positive edge delay circuit 384 is coupled to a second input to the OR gate 375. An anode of the diode 382 is coupled to the ground node. The GND pin 12 is coupled to the ground node.

Figure 2A:
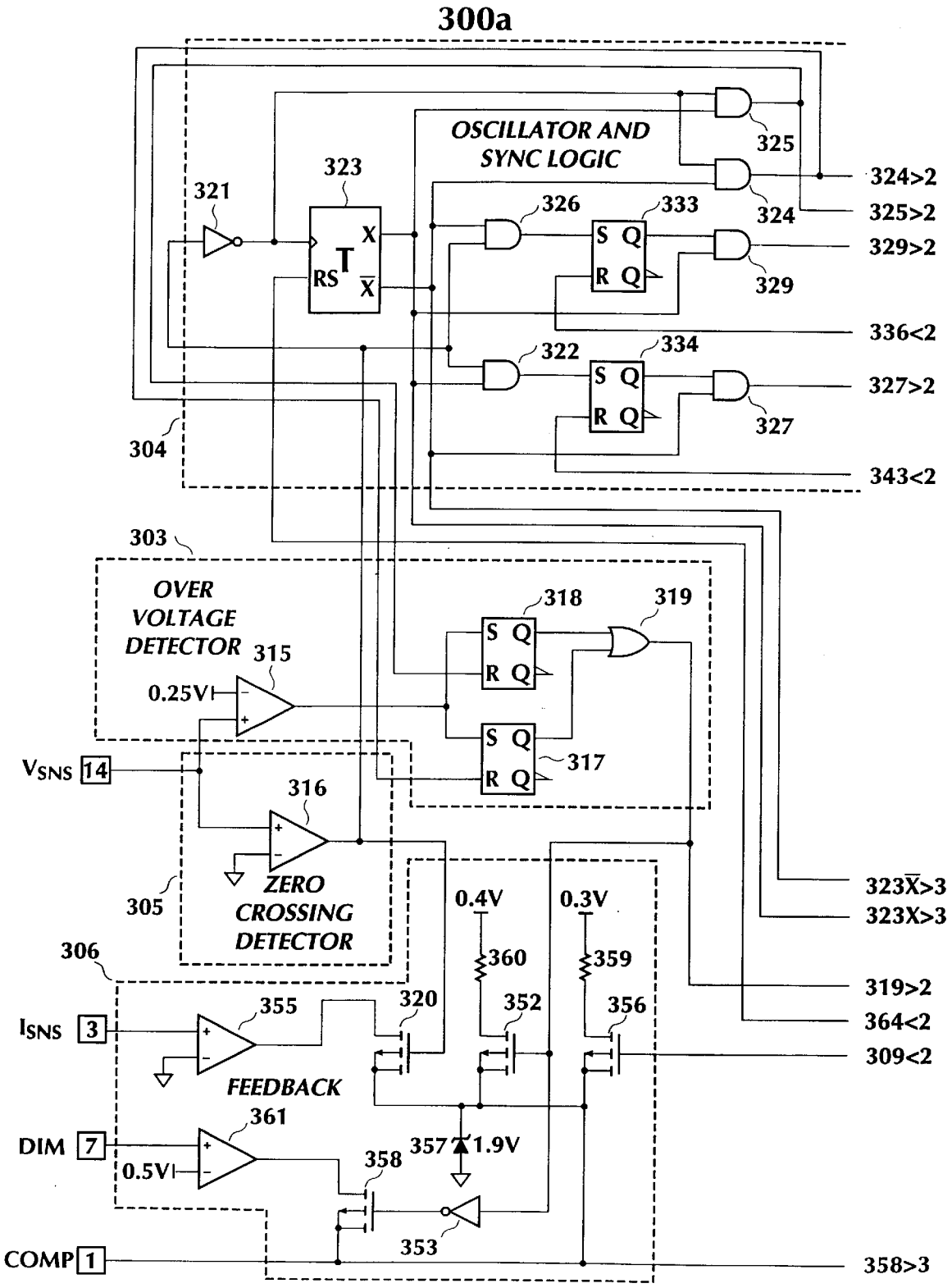
FIG. 2 shows a schematic diagram of a controller circuit of the present invention.
Figure 2B:
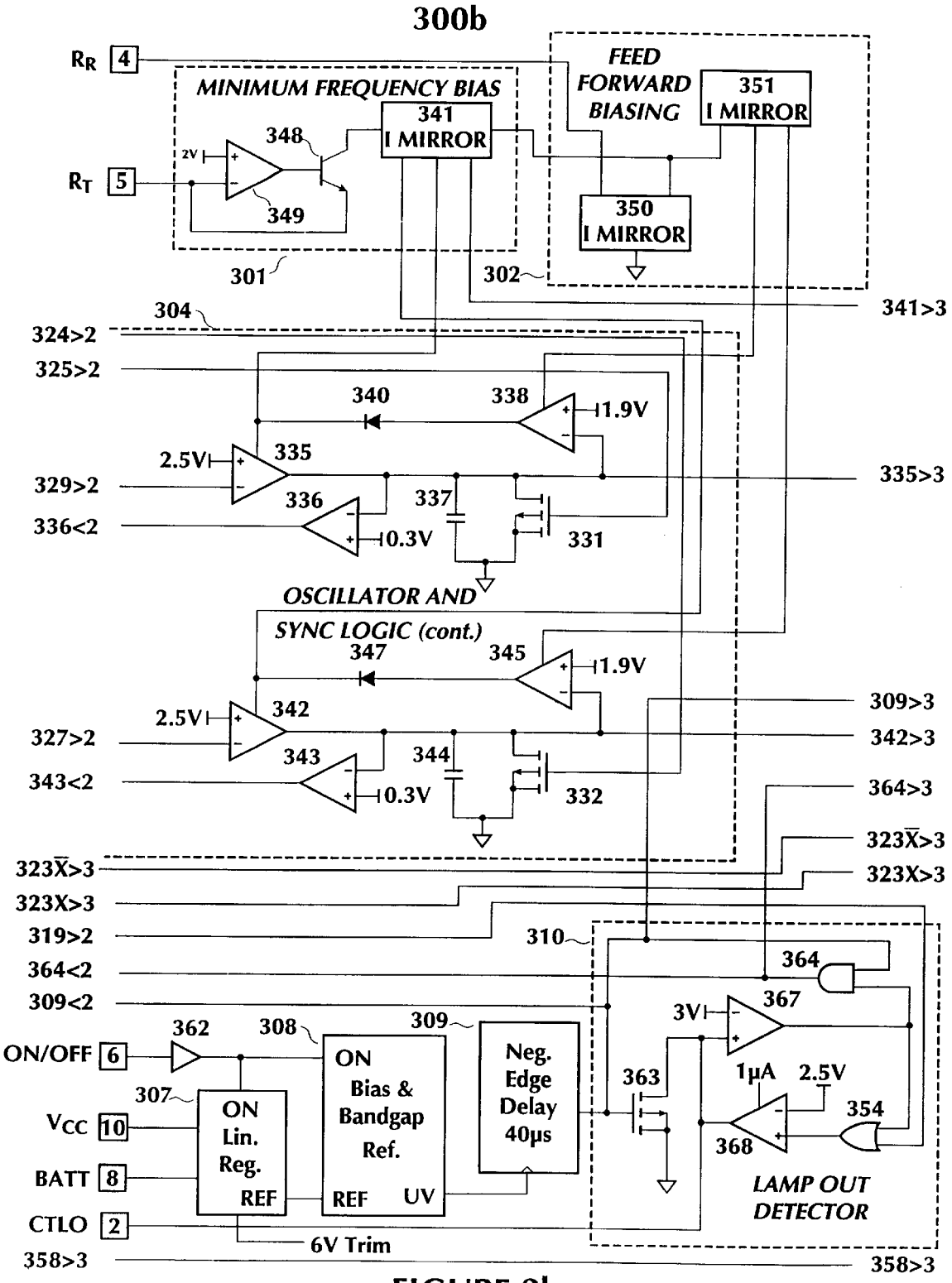
Figure 2C:
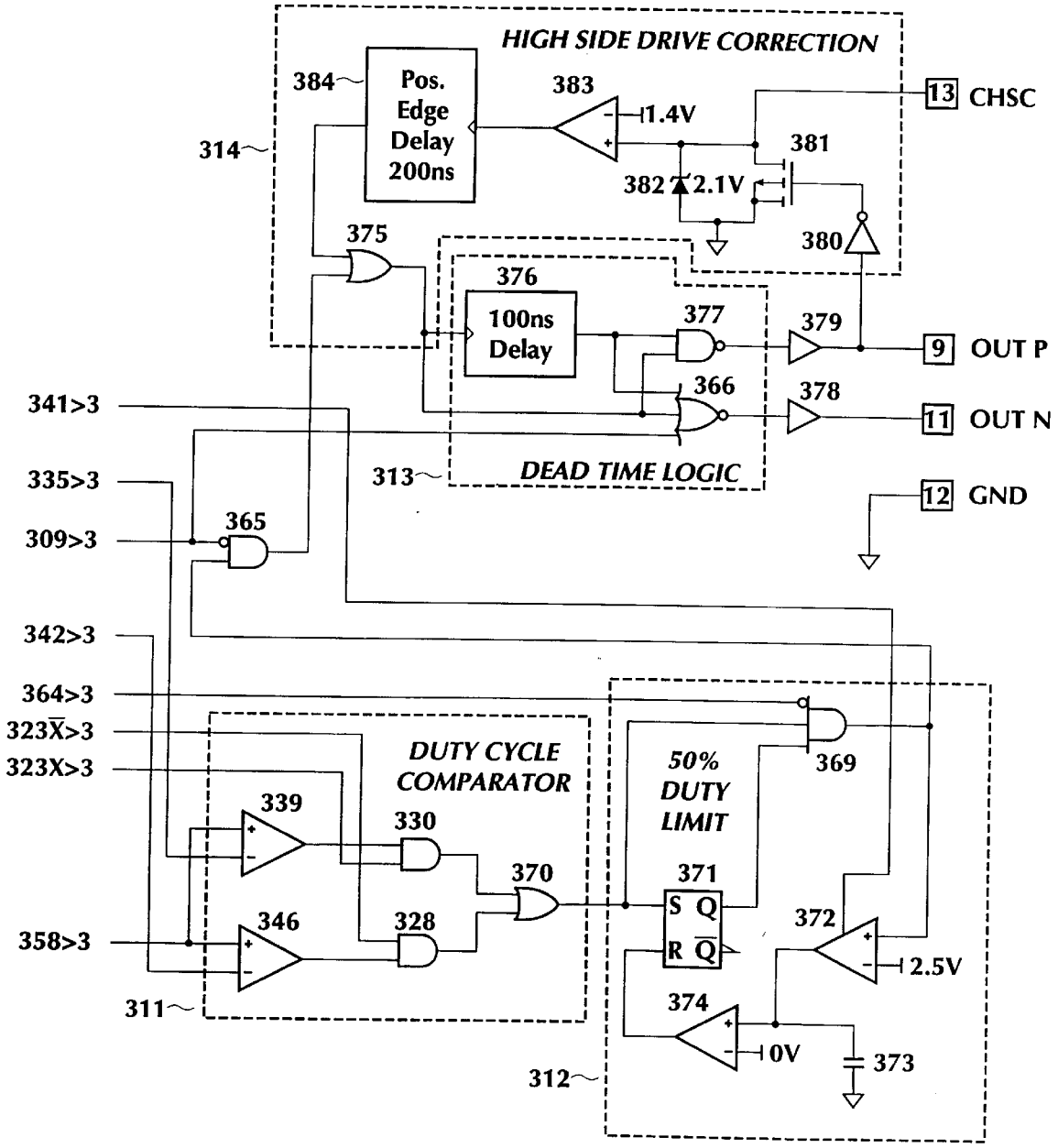
Figure 3:
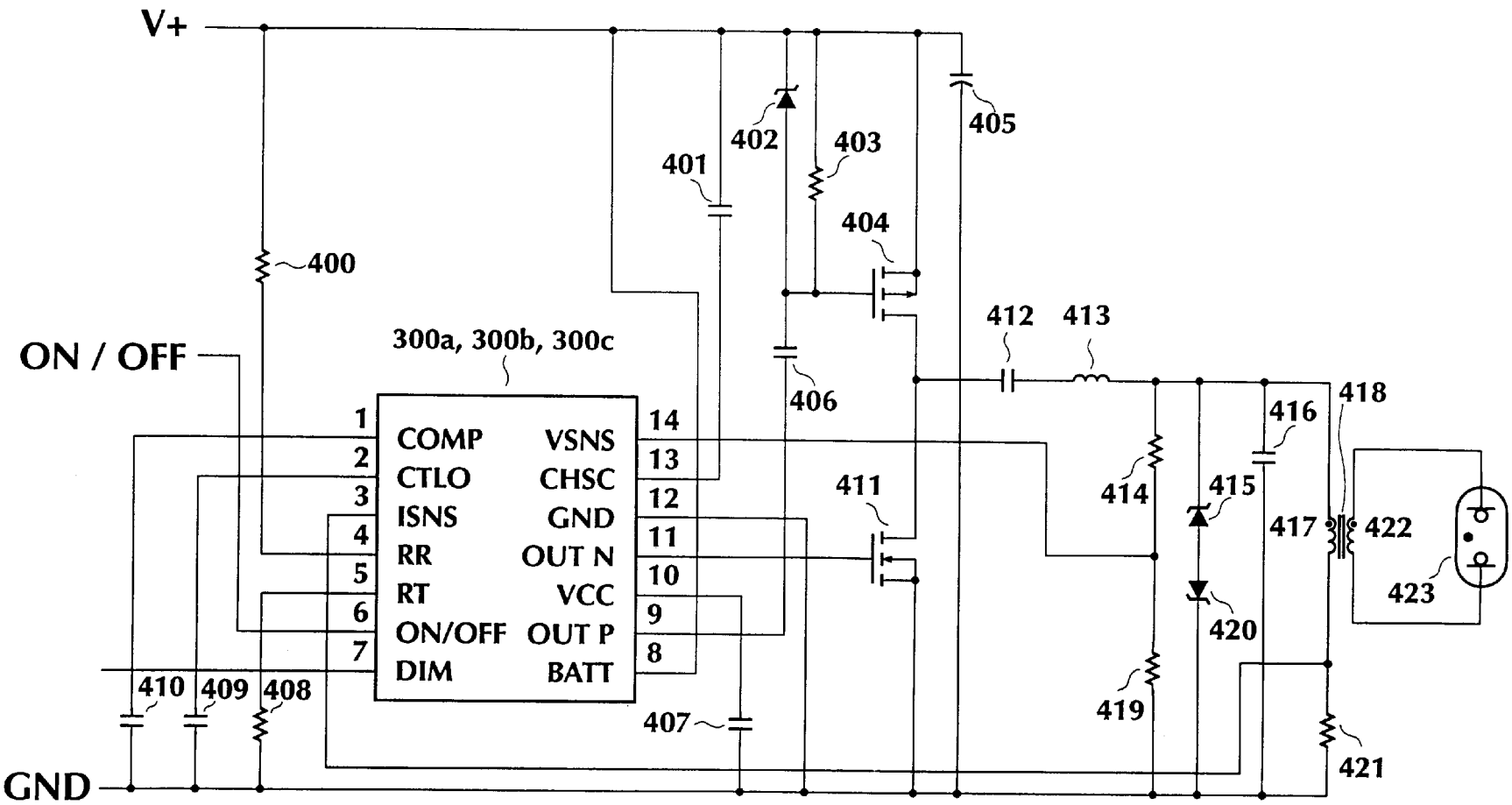
FIG. 3 shows a schematic diagram of circuits external to the controller circuit of the present invention.

FIG. 3 shows a schematic diagram of circuits external to the controller chip 300 of FIG. 2. Referring to FIG. 3, a voltage supply V+, such as a battery, is coupled to the BATT pin 8 of the controller 300, to a first terminal of a resistor 400, to a first terminal of a capacitor 401, to a cathode of a Zener diode 402, to a first terminal of a resistor 403, to a source of a PMOSFET 404 and to a first terminal of a capacitor 405. A second terminal of the resistor 400 is coupled to the RR pin 4 of the controller 300. A second terminal of the capacitor 401 is coupled to the CHSC pin 13 of the controller 300. An anode of the Zener diode 402 is coupled to a second terminal of the resistor 403, to a gate of the PMOSFET 404, and to a first terminal of a capacitor 406. A second terminal of the capacitor 406 is coupled to the OUTP pin 9 of the controller 300. A second terminal of the capacitor 405 is coupled to the ground node.

The DIM pin 7 of the controller 300 is coupled to be controlled by an external circuit for dimming the lamp. The VCC pin 10 of the controller 300 is coupled to a first terminal of a capacitor 407. A second terminal of the capacitor 407 is coupled to the ground node. The RT pin 5 of the controller 300 is coupled to a first terminal of a resistor 408. A second terminal of the resistor 408 is coupled to the ground node. The CTLO pin 2 of the controller 300 is coupled to a first terminal of a capacitor 409. A second terminal of the capacitor 409 is coupled to the ground node. The COMP pin 1 of the controller 300 is coupled to a first terminal of a capacitor 410. A second terminal of the capacitor 410 is coupled to the ground node.

The GND pin 12 of the controller 300 is coupled to the ground node. The ON/OFF pin 6 of the controller 300 is coupled to be controlled by an external circuit for turning the lamp on or off. The OUTN pin 11 of the controller 300 is coupled to a gate of an NMOSFET 411. A drain of the NMOSFET 411 is coupled to a drain of the PMOSFET 404 and to a first terminal of a capacitor 412. A source of the NMOSFET 411 is coupled to the ground node. A second terminal of the capacitor 412 is coupled to a first terminal of an inductor 413. A second terminal of the inductor 413 is coupled to a first terminal of a resistor 414, to a cathode of a Zener diode 415, to a first terminal of a capacitor 416, and to a first terminal of a primary winding 417 of a transformer 418. According to the "dot convention" for determining transformer winding polarities, the first terminal of the primary winding 417 is designated with a dot.

A second terminal of the resistor 414 is coupled to the VSNS pin 14 of the controller 300 and to a first terminal of a resistor 419. A second terminal of the resistor 419 is coupled to the ground node. An anode of the Zener diode 415 is coupled to an anode of a Zener diode 420. A cathode of the Zener diode 420 is coupled to the ground node. A second terminal of the capacitor 416 is coupled to the ground node. A second terminal of the primary winding 417 is coupled to a first terminal of a resistor 421 and to the ISNS pin 3 of the controller 300. A second terminal of the resistor 421 is coupled to the ground node.

A first terminal of a secondary winding 422 of the transformer 418 is coupled to a first terminal of a cold cathode fluorescent lamp 423. According to the "dot convention," the first terminal of the secondary winding 422 is designated with a dot. A second terminal of the secondary winding 422 is coupled to a second terminal of the fluorescent lamp 423.

Figure 4:
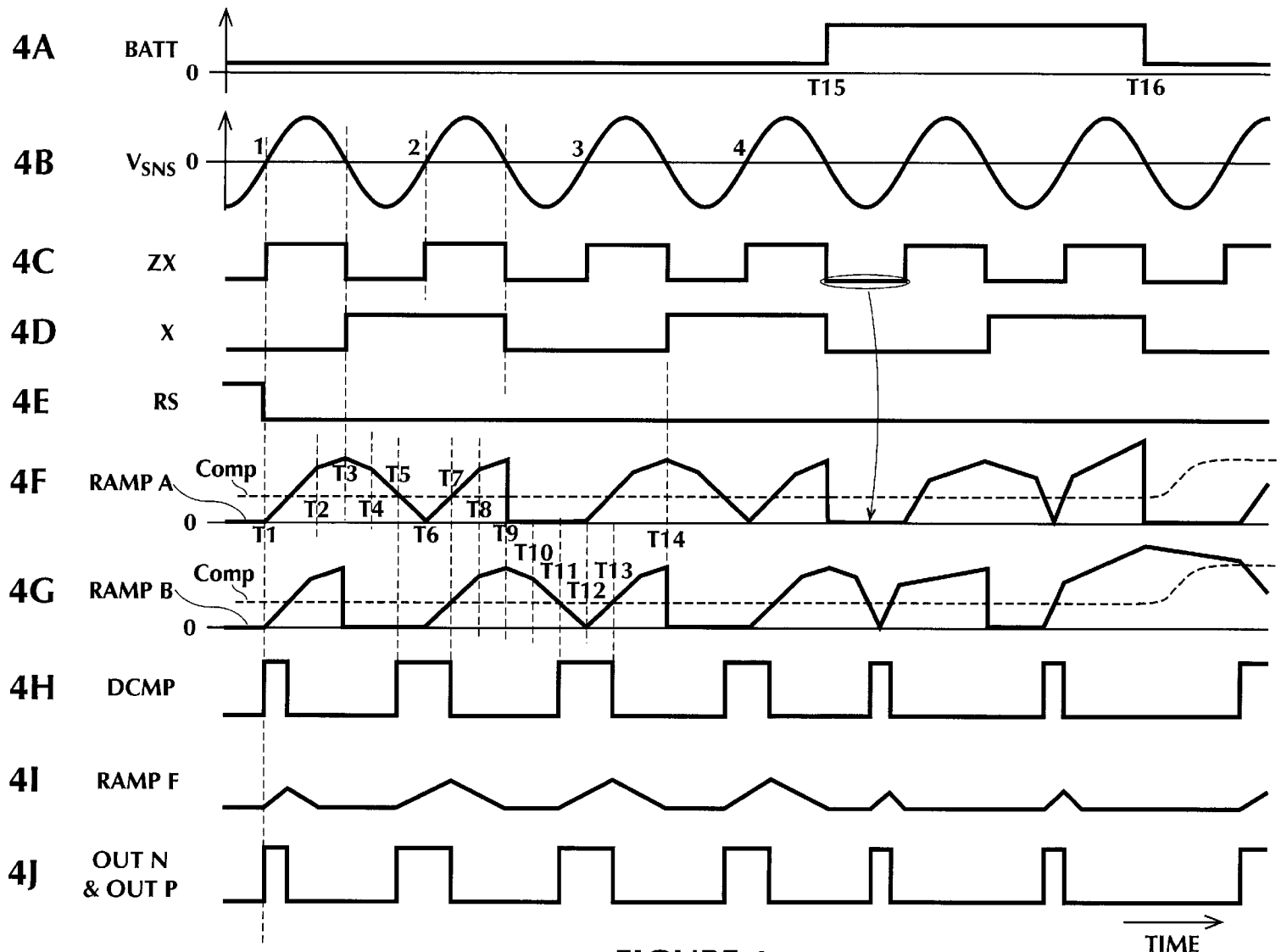
FIGS. 4A–4J show timing diagrams for signals of the circuits shown in FIGS. 2 and 3.

FIGS. 4(A–J) show timing diagrams for signals of the circuit shown in FIGS. 3 and 4. Referring to FIG. 4(A), BATT is the input signal to the BATT pin 8 of the controller 300 as shown in FIG. 3. VSNS is representative of the signal applied to the fluorescent lamp 423 shown in FIG. 4(B) and is the signal applied to the VSNS pin 14 of the controller 300 shown in FIGS. 2 and 3. Recall that an object of the invention is to drive a lamp with a resonant circuit at its resonant frequency by inputting pulses to the resonant circuit wherein the pulses are centered about a zero crossing of the lamp signal VSNS. ZX is the signal at the output of the comparator 316 of FIG. 2. The comparator 316 serves as a zero crossing detector for the signal VSNS applied to the lamp 423. The signal ZX is at a logical high voltage level when the signal VSNS is above zero volts and at a logical low voltage level when the signal VSNS is below zero volts. The X signal of FIG. 4(D) is obtained by the logic circuits coupled to the output of the comparator 316. The RAMPA signal of FIG. 4(F) is the voltage across the capacitor 337 of FIG. 2. The RAMPB signal of FIG. 4(G) is the voltage across the capacitor 344 of FIG. 2.

The DCMP signal is representative of the centered pulse signal used to drive the resonant lamp circuit. The DCMP signal is formed by logic of the duty cycle compare circuit 311 and the oscillator and sync logic circuit 304 which combine the outputs of the comparator 339 and the comparator 346 such that the pulses in the DCMP signal are alternately formed by the RAMPA comparison and the RAMPB comparison, as described above. This is effected by the X and X-not outputs of the flip-flop 323 which are coupled to the AND gates 330 and 328.

Referring to FIG. 4(F), the RAMPA signal, having been discharged by the transistor 331, begins at zero volts prior to a first positive zero crossing 1 of the VSNS signal. When the first positive zero crossing 1 of the VSNS signal is reached, at approximately the time T1, as detected by the comparator 316, the logic circuits of the oscillator and sync logic circuit 304 of FIG. 2 cause the transconductance amplifier 335 to begin charging the capacitor 337 at a rate determined by the biasing signal to the transconductance amplifier 335. The rate of charging the capacitor 337 is represented by the slope of the RAMPA signal. At the next negative zero crossing of the VSNS signal, at the time T3, the logic circuits of the oscillator and sync logic circuit 304 cause the capacitor 337 to begin discharging at the same rate that it was charged. When the voltage on the capacitor 337 reaches approximately zero (actually 0.3 volts as determined by the voltage at the non-inverting input to the comparator 336), at the time T6, the logic circuits of the oscillator and sync logic circuit 304 stop discharging the capacitor 337 and begin charging the capacitor 337.

The RAMPA signal, which represents the voltage stored on the capacitor 337, is compared by the comparator 339 of FIG. 2 to a voltage on the COMP pin 1 of the controller as shown in FIG. 2. The COMP pin 1 voltage level is an error signal formed by the brightness level set on the DIM pin 7 and the feedback signal from the ISNS pin 3. This brightness signal is shown as a horizontal dotted line superimposed on the RAMPA signal of FIG. 4(F). The output of the comparator 339 is shown by the pulse in the DCMP signal of FIG. 4(H) beginning at time T5 and ending at the time T7. This pulse is centered about the zero crossing of the signal VSNS at approximately the time T6 and is used to drive the lamp resonant circuit. At the time T9, the oscillator and sync logic circuit 304 rapidly discharges the capacitor 337 through the transistor 331. The RAMPA signal then remains low until the third positive zero crossing 3 of the signal VSNS at approximately the time T12 and the cycle described above repeats.

The RAMPB signal is the voltage on the capacitor 344. Referring back to approximately the time T3, the capacitor 344 is rapidly discharged by the oscillator and sync logic circuits 304 through the transistor 332. At the second positive zero crossing 2 of the signal VSNS, which occurs at approximately the time T6, the capacitor 344 begins to be charged by the transconductance amplifier 342 at a rate determined by the biasing signal to the transconductance amplifier 342. At the time T9, when the signal VSNS reaches a negative zero crossing, the capacitor 344 is discharged by the oscillator and sync logic circuit 304 at the same rate that it was charged. At the time T12, when the voltage on the capacitor 344 reaches approximately zero (actually 0.3 volts as determined by the voltage at the non-inverting input to the comparator 343), the oscillator and sync logic circuit 304 stops discharging the capacitor 344 and begins charging the capacitor 344.

The RAMPB signal, which represents the voltage stored on the capacitor 344, is compared by the comparator 346 of FIG. 2 to a voltage level on the COMP pin 1 of the controller as shown in FIG. 2. The COMP pin 1 voltage level is an error signal formed by the brightness level set on the DIM pin 7 and the feedback signal from the ISNS pin 3. This brightness signal is shown as a horizontal dotted line superimposed on the RAMPB signal of FIG. 4(G). The output of the comparator 346 is shown by the pulse in the DCMP signal of FIG. 4(H) beginning at time T11 and ending at the time T13. This pulse is centered about the zero crossing of the signal VSNS at approximately the time T12 and is used to drive the lamp resonant circuit. At the time T14, the oscillator and sync logic circuit 304 rapidly discharges the capacitor 344 through the transistor 331. The RAMPB signal then remains low until the fourth positive zero crossing 4 of the signal VSNS and the cycle described above repeats.

Thus, a circuit for centering pulses about a zero crossing without using a phase comparator or phase locked loop has been described. Rather, the signals RAMPA and RAMPB are synchronously interleaved to obtain the object of the invention. Two ramp signals RAMPA and RAMPB are needed, rather than a single ramp signal, because it is not assured that the zero crossings will coincide precisely with the capacitors 339 and 344 being discharged to zero approximately volts (0.3 volts). For this reason, the capacitors 339 and 344 are rapidly discharged at the times T9 and T14, respectively. However, it will be apparent that a single ramp signal could be used to generate all the pulses in the DCMP signal, but with reduced accuracy in centering the pulses about zero crossings of the VSNS signal.

The invention synchronizes the pulses of the DCMP signal to the sinusoidal signal VSNS within only one cycle, whereas, a phase locked loop could take longer or could fail to synchronize at all.

Referring to FIG. 4(F), it can be seen that the RAMPA signal changes slope at the times T2 and T4, and the RAMPB signal changes slope at the times T8, and T10. To achieve the object of centering the pulses about a zero crossing, it is important that each of the capacitors be charged and discharged at the same rates. For example, from the time T1 to the time T6, the RAMPA signal must be symmetrical about the time T3 and from the time T6 to the time T12, the RAMPB signal must be symmetrical about the time T9. As described above, the RAMPA and RAMPB signals are compared to the voltage level shown by the dotted line superimposed on the RAMPA and RAMPB signals shown in FIGS. 4(F and G). Therefore, the level of the voltage on the capacitor 337 or 344 is not important so long as the voltage level on the capacitor 337 or 344 is higher than the voltage COMP represented by the dotted line and so long as the capacitors are charged and discharged at equal rates.

The rate at which the capacitor 337 is charged depends upon the bias current to the transconductance amplifier 335. The bias current to the transconductance amplifier 335 has two components. A first component is provided by the current mirror 341. A second component is provided by the transconductance amplifier 338 through the diode 340. The diode 340 prevents current from entering the output of the transconductance amplifier 338. Similarly, the rate at which the capacitor 344 is charged depends upon the bias current to the transconductance amplifier 342. The bias current to the transconductance amplifier 342 also has two components. A first component is provided by the current mirror 341. A second component is provided by the transconductance amplifier 345 through the diode 347. The diode 347 prevents current from entering the output of the transconductance amplifier 345.

At the time T1, upon the first positive zero crossing of the signal VSNS, the output of the AND gate 329 is a logical low voltage, the voltage on the capacitor 337 is below 1.9 volts, and the transconductance amplifier 335, biased by both the current mirror 341 and the transconductance amplifier 338, charges the capacitor 337. Once the voltage on the capacitor 337 reaches 1.9 volts, at the time T2, the transconductance amplifier 338 stops providing biasing current to the transconductance amplifier 335 so that the capacitor 337 is charged at a slower rate, as shown by the reduced slope of the RAMPA circuit between the times T2 and T3. Then, once the negative zero crossing of VSNS occurs, at the time T3, the capacitor 337 is discharged at the slower rate until the capacitor 337 is discharged to below 1.9 volts. Once the capacitor 337 is discharged to below 1.9 volts, at the time T4, the transconductance amplifier 338 causes the rate at which the transconductance amplifier 335 discharges the capacitor 337 to increase again to correspond to the rate that the capacitor 337 was charged between the times T1 and T2.

Similarly, once the voltage on the capacitor 344 is above 1.9 volts, the rate at which the transconductance amplifier charges and discharges the capacitor 344 is reduced because the transconductance amplifier 345 stops providing an additional biasing current to the transconductance amplifier 342. When the voltage on the capacitor 344 is below 1.9 volts, the rate at which the transconductance amplifier 342 charges the capacitor 344 is increased because the transconductance amplifier 345 provides the additional biasing current.

A benefit of this technique is that the voltage headroom required for the signals RAMPA and RAMP3 is reduced (i.e. lower supply voltage levels are required) while maintaining a relatively high gain when the RAMPA and RAMPB signals are below the 1.9 volt threshold. This relatively high gain increases the accuracy of the pulse widths and the ability to control the slope of the RAMPA and RAMPB signals increases the ability to control the pulse widths of the DCMP signal.

If voltage on the external resistor 400, illustrated in FIG. 3 increases, current into the RR pin 4 of the controller 300 will increase, as shown in FIG. 4 by the transition in the signal BATT at the time T15 to the time T16, and the capacitors 337 and 344 will be charged even more rapidly than described above. This results in a steeper slope in the RAMPA and RAMPB signals. Thus, the pulses in the DCMP signal are narrower to reflect the reduced duty cycle required to maintain a given lamp brightness. This is achieved by the current mirrors 350 and 351 increasing the biasing current to the transconductance amplifiers 338 and 345. Thus, when the RAMPA and RAMPB signals are below 1.9 volts, the slope is increased in comparison to the slope which results when BATT is at the lower level. When the RAMPA and RAMPB signals are above 1.9 volts, the slope is the same as when BATT is at the lower level because the bias current provided by the current mirror 341 is not increased when BATT is at the higher level. Thus, another means for controlling the slope of the RAMPA and RAMPB signals is disclosed. It will be apparent that any number of different slopes which are selected based on any criteria could be employed, or a constant slope could be employed.

Figure 5:
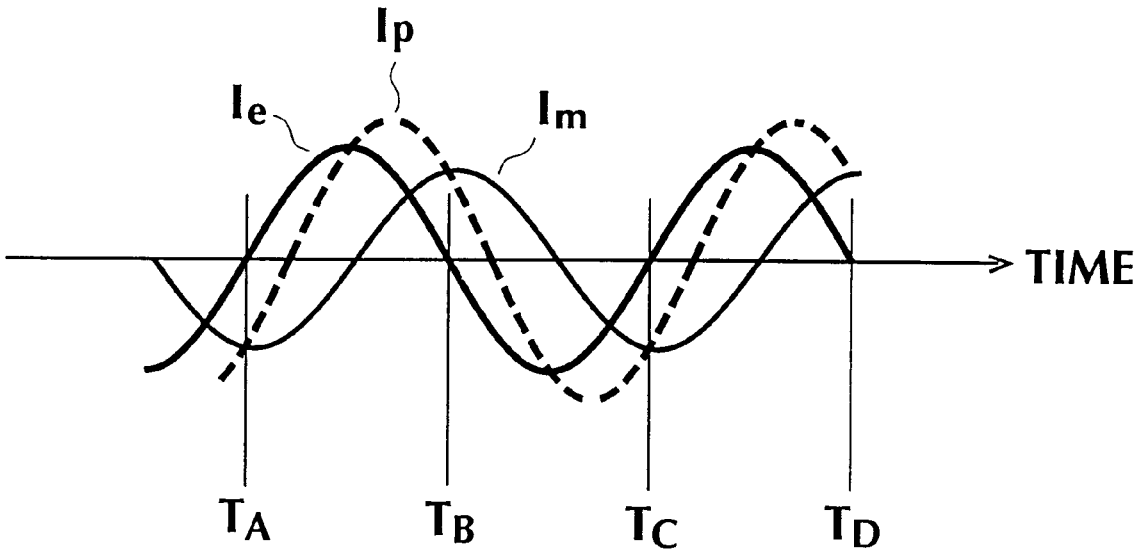
FIG. 5 shows a diagram of the primary current, the magnetization current and the effective current of FIG. 1.

FIG. 5 shows a diagram of the primary current signal Ip, the magnetization current signal Im and the effective current signal Ie of FIG. 1. The magnitude of the magnetization current signal Im is exaggerated in FIG. 5 for illustrative purposes. Recall that an object of the invention is to determine the value of the effective current signal Ie by monitoring only the primary current signal Ip. The value of the secondary current signal Is (FIG. 1) can then be determined by multiplying the effective current signal Ie by the ratio of turns of the primary winding to the secondary winding. The invention achieves this object by integrating the primary current signal Ip from the time TA to the time TB which is 0 to 180 degrees of the effective current signal Ie. This removes the effect of the magnetization current signal Im from the primary current signal Ip because the magnetization current Im is 90 degrees out of phase with the voltage Vp across the primary winding Lp. As can be seen from FIG. 5, the magnetization current Im crosses the zero axis halfway between the time TA and the time TB. Therefore, integrating the magnetization current signal Im over the period TA to TB has zero as a result.

As stated previously, VSNS is representative of the signal applied to the fluorescent lamp 423 shown in FIG. 4 and the signal applied to the VSNS pin 14 of the controller 300 shown in FIG. 2. Therefore, the signal VSNS in FIGS. 2 and 3 is represented by the signal Vp in FIG. 1. The signal across the resistor 421 of FIG. 3 which is coupled to the ISNS pin 3 of the controller 300 is proportional to the current through the primary winding 417 of FIG. 3 and is represented by the current Ip in FIG. 5. Therefore, a magnetization current can be eliminated from the circuits of FIGS. 2 and 3 by integrating the signal coupled to the ISNS pin 3 during periods when the signal VSNS is above the ground level.

Referring to FIGS. 2 and 3, the voltage at the VSNS pin 14 of the controller 300 is compared to ground by the comparator 316. As can be seen from FIG. 5, the output ZX of the comparator 316 is at a logical high voltage when the signal VSNS is above the ground level. The periods during which the signal VSNS is above the ground level (when ZX is a logical high voltage) correspond to the periods during which it is desired to integrate the signal coupled to the ISNS pin 3 of the controller 300. Therefore, the integration occurs during periods when the signal ZX is a logical high voltage. As can be seen from FIG. 2, the signal coupled to the ISNS pin 3 of the controller is coupled to the non-inverting input of the transconductance amplifier 355. The inverting input to the transconductance amplifier is coupled to the ground node. Therefore, the transconductance amplifier 355 will source current when the signal on the ISNS pin 3 of the controller 300 is above the ground level and will draw current when the signal on the ISNS pin 3 is below the ground level.

When the signal ZX is a logical high voltage, the transistor 320 is turned on so that the output of the transconductance amplifier 355 charges or discharges the capacitor 410 coupled to the COMP pin 1 of the controller 300 (FIG. 3). A portion of the voltage on the capacitor 410 is proportional to the result of the integration operation and is coupled to the non-inverting inputs to the comparators 339 and 346 of FIGS. 2 and 3. The voltage on the DIM pin 7 also contributes to the voltage on the capacitor 410. The comparators 339 and 346 comprise a feedback loop for controlling a current in the lamp 423. As explained in reference to FIG. 5, the level of the dotted lines superimposed on the RAMPA and RAMPB signals is applied to the non-inverting inputs of the comparators 339 and 346. The level of the dotted lines is controllable from the DIM pin 7 of the controller.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications may be made in the embodiments chosen for illustration without departing from the spirit and scope of the invention.

Specifically, it will be apparent to one of ordinary skill in the art that the device of the present invention could be implemented in several different ways and the apparatus disclosed above is only illustrative of the preferred embodiment of the invention and is in no way a limitation. For example, it would be within the scope of the invention to vary the values of the various components and voltage levels disclosed herein. It will be apparent that transistors of one type, such as NMOS, PMOS, bipolar pnp or bipolar npn can be interchanged with a transistor of another type, and in some cases interchanged with diodes, with appropriate modifications, and so forth. Also a switch may be implemented with a transistor of any type. Further, the logic circuits of the oscillator and sync logic circuit 304 could be implemented in many different ways while remaining within the spirit and scope of the invention.

What is claimed is:

1. A circuit for sensing a current in a secondary winding of a transformer comprising:

a. a resistor for monitoring a first current in a primary winding of the transformer wherein the resistor is coupled in series with the primary winding;

b. means for forming a second current coupled to the resistor wherein the second current is representative of the first current during periods wherein a voltage applied to the primary winding is positive and wherein the second current is zero during periods when the voltage applied to the primary winding is negative and wherein the means for forming the second current comprises:

(1) a transconductance amplifier having an inverting input, a non-inverting input and a transconductance output wherein the inverting input is coupled to a reference voltage level, the non-inverting input is coupled to the resistor and the transconductance output is coupled to a capacitor;

(2) means for selectively preventing the transconductance output from charging the capacitor; and (3) means for sensing a voltage representative of a voltage across the primary winding coupled to control the means for selectively preventing; and c. a charge storage element coupled to receive the second current.

2. The circuit according to claim 1 wherein the voltage across the primary winding is substantially a sinusoid centered substantially at ground level.

3. The circuit according to claim 2 wherein the means for sensing comprises a comparator coupled to compare the voltage representative of the voltage across the primary winding to a level of zero volts for forming a comparator output and wherein the means for selectively preventing comprises a transistor coupled to be controlled by the comparator output.

4. The circuit according to claim 3 further comprising:

a. a resonant circuit coupled to the primary winding; and b. means for providing power to the resonant circuit wherein a level of the power is controlled by a voltage level on the capacitor.

5. The circuit according to claim 4 further comprising:

a. a fluorescent lamp coupled to the secondary winding; and b. means for adjusting the voltage level on the capacitor based upon a desired brightness level of the fluorescent lamp.

6. A circuit for sensing a current in a secondary winding of a transformer comprising:

a. a resistor coupled in series with a primary winding of the transformer;

b. a transconductance amplifier coupled to the resistor for forming a first current signal wherein the first current signal is representative of a current in the primary winding;

c. a capacitor coupled to receive the first current signal; and d. means for preventing the capacitor from receiving the first current signal during periods when a voltage signal applied to the primary winding is below zero.

7. The circuit according to claim 6 further comprising:

a. a circuit for delivering power to the primary winding; and b. a load coupled to the secondary winding.

8. The circuit according to claim 7 wherein a level of power delivered to the primary winding is controlled by a voltage level on the capacitor.

9. The circuit according to claim 8 wherein the voltage level on the capacitor may be adjusted based upon a desired level of power to be delivered to the load.

10. The circuit according to claim 9 further comprising a resonant circuit coupled to the primary winding.

11. The circuit according to claim 10 wherein the load is a fluorescent lamp.

12. A method of sensing a current in a secondary winding of a transformer comprising the steps of:

a. monitoring a current signal representative of a current in the primary winding of the transformer;

b. monitoring a voltage signal representative of a voltage across the primary winding wherein the voltage across the primary winding is substantially a sinusoid centered substantially at ground level;

c. integrating the current signal over 180 degrees of the voltage signal;

d. determining a desired power level to be delivered to a load coupled to the secondary winding;

e. adding a quantity to a result of the step of integrating wherein the quantity is representative of the desired power level; and f. delivering power to a circuit coupled to the primary winding based upon a result of the step of adding.

13. The method according to claim 12 wherein the voltage across the primary winding is substantially a sinusoid centered substantially at ground level and wherein the step of integrating is performed over alternate periods between zero crossings of the sinusoid.

14. The method according to claim 13 wherein the load is a fluorescent lamp.

15. The method according to claim 14 wherein the circuit coupled to the primary winding is a resonant circuit.

16. A circuit for delivering power to a fluorescent lamp comprising:

a. a transformer having a primary winding and a secondary winding wherein the fluorescent lamp is coupled to the secondary winding;

b. a resonant circuit coupled to the primary winding;

c. a power source coupled to the resonant circuit; and d. a controller circuit for controlling a level of power delivered to the resonant circuit based upon a desired level of brightness of the fluorescent lamp and based upon a level of current in the lamp wherein the controller comprises:

(1) means for monitoring a voltage across a resistor coupled in series with the lamp;

(2) means for monitoring a voltage across the primary winding;

(3) means for charging a capacitor coupled to the controller with a current representative of the voltage across the resistor during periods when the voltage across the primary winding is positive;

(4) means for adjusting the voltage across the capacitor based upon the desired level of brightness; and (5) means for generating a series of pulses delivered to the resonant circuit wherein a width of the pulses is representative of the voltage across the capacitor.

17. The circuit according to claim 16 whereby error in a feedback loop caused by a magnetization current of the transformer is eliminated.

18. A circuit for sensing a current in a secondary winding of a transformer comprising:

a. a resistor for monitoring a first current in a primary winding of the transformer wherein the resistor is coupled in series with the primary winding and wherein at least a portion of the first current flows through the resistor;

b. means for forming a second current coupled to the means for monitoring wherein the second current is representative of the first current during periods wherein a voltage applied to the primary winding is positive and wherein the second current is zero during periods when the voltage applied to the primary winding is negative, and c. a charge storage element coupled to receive the second current.

19. A circuit for sensing a current in a secondary winding of a transformer comprising:

a. a resistor for monitoring a current in a primary winding of the transformer wherein at least a portion of the current flows through the resistor;

b. means for integrating coupled to the resistor for integrating a signal formed across the resistor; and c. means for selectively enabling the means for integrating wherein the means for integrating is enabled during periods wherein a voltage applied to the primary winding is positive and wherein the means for integrating is disabled during periods when the voltage applied to the primary winding is negative.

20. A circuit for sensing a current in a secondary winding of a transformer comprising:

a. means for monitoring a current in a primary winding of the transformer;

b. means for integrating a signal formed by the means for monitoring, the means for integrating coupled to the means for monitoring; and c. a comparator for enabling the means for integrating during selected half-cycles of the voltage applied to the primary winding and for disabling the means for integrating during alternate half-cycles of the voltage applied to the primary winding wherein the comparator is coupled to the means for integrating.

21. The circuit according to claim 20 wherein the means for monitoring comprises a resistor wherein at least a portion of the current in the primary winding flows through the resistor.

22. The circuit according to claim 20 wherein the means for integrating comprises:

a. a transconductance amplifier having an input coupled to the resistor; and b. a capacitor coupled to receive a current formed by the transconductance amplifier.

23. The circuit according to 22 further comprising:

a. a resonant circuit coupled to the primary winding; and b. means for providing power to the resonant circuit wherein a level of the power is controlled by a voltage level on the capacitor.

24. The circuit according to claim 23 further comprising:

a. a fluorescent lamp coupled to the secondary winding; and b. means for adjusting the voltage level on the capacitor based upon a desired brightness level of the fluorescent lamp.

25. A circuit for sensing a current in a secondary winding of a transformer comprising:

a. a resistor for monitoring a first current in a primary winding of the transformer wherein at least a portion of the first current flows through the resistor;

b. means for forming a second current coupled to the means for monitoring wherein the second current is representative of the first current during periods wherein a voltage applied to the primary winding is positive and wherein the second current is zero during periods when the voltage applied to the primary winding is negative and wherein the means for forming the second current comprises:

(1) a transconductance amplifier having an inverting input, a non-inverting input and a transconductance output wherein the inverting input is coupled to a reference voltage level, the non-inverting input is coupled to the resistor and the transconductance output is coupled to the capacitor;

(2) means for selectively preventing the transconductance output from charging the capacitor; and (3) means for sensing a voltage representative of a voltage across the primary winding coupled to control the means for selectively preventing; and c. a charge storage element coupled to receive the second current.

26. The circuit according to claim 25 wherein the means for sensing comprises a comparator coupled to compare the voltage representative of the voltage across the primary winding to a level of zero volts for forming a comparator output and wherein the means for selectively preventing comprises a transistor coupled to be controlled by the comparator output.

27. The circuit according to claim 26 further comprising:

a. a resonant circuit coupled to the primary winding; and b. means for providing power to the resonant circuit wherein a level of the power is controlled by a voltage level on the capacitor.

28. The circuit according to claim 27 further comprising:

a. a fluorescent lamp coupled to the secondary winding; and b. means for adjusting the voltage level on the capacitor based upon a desired brightness level of the fluorescent lamp.

* * * * *

UNITED STATES PATENT AND TRADEMARK OFFICE

CERTIFICATE OF CORRECTION

PATENT NO. : 5,965,989
DATED : October 12, 1999
INVENTOR(S) : Urs H. Mader

It is certified that error appears in the above-identified patent and that said Letters Patent is hereby corrected as shown below:

Title Page:
Item [56] under U.S. Patent Documents, please delete "4,210,746" and insert therefor -- 4,210,846 --
Under Other Publications, please delete "A.A. O'Connor" and insert therefor -- J.A. O'Connor --.

Column 1,
Line 58, please delete "Ie" and insert therefor -- Im --.

Column 2,
Line 41, please delete "Fig. 2" and insert therefor -- Figs. 2a-c --.
Line 53, please delete "Fig. 2" and insert therefor -- Figs. 2a-c --.
Line 53, please delete "300" and insert therefor -- 300a-c --.
Line 55, please delete "300" and insert therefor -- 300a-c --.
Line 56, please delete "300" and insert therefor -- 300a-c --.
Line 59, after "controller" please insert -- 300a-c --.

Column 5,
Line 67, please delete "300" and insert therefor -- 300a-c --.
Line 67, please delete "Fig. 2" and insert therefor -- Figs. 2a-c --.

Column 6,
Line 2, please delete "300" and insert therefor -- 300a-c --.
Line 7, please delete "300" and insert therefor -- 300a-c --.
Line 9, please delete "300" and insert therefor -- 300a-c --.
Line 13, please delete "300" and insert therefor -- 300a-c --.
Line 15, please delete "300" and insert therefor -- 300a-c --.
Line 17, please delete "300" and insert therefor -- 300a-c --.
Line 20, please delete "300" and insert therefor -- 300a-c --.
Line 22, please delete "300" and insert therefor -- 300a-c --.
Line 25, please delete "300" and insert therefor -- 300a-c --.
Line 28, please delete "300" and insert therefor -- 300a-c --.
Line 29, please delete "300" and insert therefor -- 300a-c --.
Line 31, please delete "300" and insert therefor -- 300a-c --.
Line 45, please delete "300" and insert therefor -- 300a-c --.
Line 53, please delete "300" and insert therefor -- 300a-c --.
Line 66, please delete "300" and insert therefor -- 300a-c --.

UNITED STATES PATENT AND TRADEMARK OFFICE

CERTIFICATE OF CORRECTION

PATENT NO. : 5,965,989
DATED : October 12, 1999
INVENTOR(S) : Urs H. Mader

It is certified that error appears in the above-identified patent and that said Letters Patent is hereby corrected as shown below:

Column 7,
Line 1, please delete "300" and insert therefor -- 300a-c --.
Line 2, please delete "Figs. 2 and 3" and insert therefor -- Figs. 2a-c and 3 --.
Line 7, please delete "Fig. 2" and insert therefor -- Fig. 2a --.
Line 14, please delete "Fig. 2" and insert therefor -- Fig. 2b --.
Line 15, please delete "Fig. 2" and insert therefor -- Fig. 2b --.
Line 33, please delete "Fig. 2" and insert therefor -- Fig. 2a-b --.
Line 49, please delete "Fig. 2" and insert therefor -- Fig. 2c --.
Line 50, please delete "Fig. 2" and insert therefor -- Fig. 2a --.

Column 8,
Line 17, please delete "Fig. 2" and insert therefor -- Fig. 2c --.
Line 18, please delete "Fig. 2" and insert therefor -- Fig. 2a --.

Column 9,
Line 55, please delete "300" and insert therefor -- 300a-c --.

Column 10,
Line 36, please delete "300" and insert therefor -- 300a-c --.
Line 43, please delete "300" and insert therefor -- 300a-c --.
Line 50, please delete "300" and insert therefor -- 300a-c --.
Line 52, please delete "Fig. 2" and insert therefor -- Fig. 2a --.
Line 58, please delete "300" and insert therefor -- 300a-c --.
Line 64, please delete "300" and insert therefor -- 300a-c --.

UNITED STATES PATENT AND TRADEMARK OFFICE

CERTIFICATE OF CORRECTION

PATENT NO. : 5,965,989
DATED : October 12, 1999
INVENTOR(S) : Urs H. Mader

It is certified that error appears in the above-identified patent and that said Letters Patent is hereby corrected as shown below:

Column 11,
Line 1, please delete "Figs. 2 and 3" and insert therefor -- Fig. 2c --.

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*